United States Patent [19]

Lawson et al.

[11] Patent Number: 4,836,224

[45] Date of Patent: Jun. 6, 1989

[54] CIGARETTE

[75] Inventors: Jerry W. Lawson, Clemmons; Bruce R. Bullings; Thomas A. Perfetti, both of Winston-Salem, all of N.C.

[73] Assignee: R. J. Reynolds Tobacco Company, Winston-Salem, N.C.

[21] Appl. No.: 137,987

[22] Filed: Dec. 24, 1987

Related U.S. Application Data

[63] Continuation-in-part of Ser. No. 12,922, Feb. 10, 1987.

[51] Int. Cl.[4] ..... A24D 1/00; A24D 1/02

[52] U.S. Cl. ..... 131/336; 131/335; 131/352; 131/365

[58] Field of Search ..... 131/352, 365, 335, 336

[56] References Cited

U.S. PATENT DOCUMENTS

| | | |
|---|---|---|
| 2,152,236 | 3/1939 | Batchelder . |
| 2,207,694 | 7/1940 | Baier . |
| 2,766,145 | 10/1956 | Jones . |
| 2,914,072 | 11/1959 | Tyrer et al. . |
| 3,095,882 | 7/1963 | Hind et al. . |
| 3,109,436 | 11/1963 | Bavley et al. . |
| 3,136,319 | 6/1964 | Jarboe et al. . |
| 3,280,823 | 10/1966 | Bavley et al. . |
| 3,319,630 | 5/1967 | Orrmins . |
| 3,422,819 | 1/1969 | Jones et al. . |
| 3,584,630 | 6/1971 | Inskeep . |
| 3,861,400 | 1/1975 | Perkins et al. . |
| 3,878,850 | 4/1975 | Gibson et al. . |
| 3,924,642 | 12/1975 | Eicher et al. . |
| 3,924,644 | 12/1975 | Anderson et al. . |
| 4,125,118 | 11/1978 | Rudner . |
| 4,236,532 | 12/1980 | Schweizer et al. . |
| 4,256,126 | 3/1981 | Seligman et al. . |
| 4,286,604 | 9/1981 | Ehretsmann et al. . |
| 4,300,576 | 11/1981 | van der Loo et al. . |
| 4,481,960 | 11/1984 | Brooks . |
| 4,506,682 | 3/1985 | Muller . |
| 4,595,024 | 6/1986 | Greene et al. . |
| 4,676,259 | 6/1987 | Ellis et al. . |
| 4,714,082 | 12/1987 | Banerjee et al. . |
| 4,715,389 | 12/1987 | Lynm et al. . |

FOREIGN PATENT DOCUMENTS

| | | |
|---|---|---|
| 103969 | 3/1984 | European Pat. Off. . |
| 3312159 | 4/1983 | Fed. Rep. of Germany . |
| 988608 | 8/1951 | France . |
| 124711 | 6/1983 | Japan . |
| 446368 | 4/1936 | United Kingdom . |
| 1111007 | 4/1968 | United Kingdom . |
| 1495941 | 2/1974 | United Kingdom . |
| 2094611 | 9/1982 | United Kingdom . |
| 2185175 | 7/1987 | United Kingdom . |

OTHER PUBLICATIONS

Abdallah, Sensory Testing of Cigarette Smoke, Panel Selection, Training and Use; North Carolina State Univ. Ph.D. Thesis (1974).

Armitage et al., *Quarterly Journal of Experimental Physiology*, vol. 59, pp. 55–61 (1974).

(List continued on next page.)

*Primary Examiner*—V. Millin

[57] ABSTRACT

Cigarettes having high nicotine content tobacco cut filler are rendered smooth smoking and palatable by incorporating an organic acid additive therein. For example, a cigarette having a cut filler with a blend nicotine content of greater than 2 percent has at least one organic acid additive incorporated into the cigarette in an amount of greater than 1 percent. Smooth smoking cigarettes yielding good tobacco taste and minimal off-taste are provided when the majority of the organic acid additive is levulinic acid. The levulinic acid can be in a dissociated and/or nondissociated form. For cigarettes having filter elements, at least a portion of the levulinic acid can be present in the filter element. Alternatively, cigarettes can have at least a portion of the levulinic acid provided in the form of nicotine levulinate. Cigarettes having high nicotine content tobaccos and levulinic acid and cigarettes having a salt such as nicotine levulinate incorporated therein can exhibit low FTC "tar" to nicotine ratios while providing a smooth, palatable and flavorful taste.

36 Claims, 1 Drawing Sheet

OTHER PUBLICATIONS

Gabel et al., *Ukr. Khim. Zbur.*, 5, pp. 167–184 (1930).
Houseman, *Beitr. Tabakforsch.*, vol. 7, pp. 142–147 (1973).
Jenkins et al., *Int'l Journal of Applied Radiation and Isotopes*, vol. 27, pp. 323–324 (1976).
Leffringwell et al., *Tobacco Flavoring for Smoking Products*, pp. 11–15 (1972).
Leonard, *Industrial and Engineering Chemistry*, vol. 48, 1331–1341 (1956).
Perfetti, *Beitrage Tabakforschung Int'l*, vol. 12, No. 2, pp. 43–54 (1983).
Sensabaugh et al., *Tobacco Science*, vol. II, pp. 25–30 (1967).
Wynder et al., *Tobacco and Tobacco Smoke*, p. 428 (1967).
Dickens, *On Cancer and Hormones*, pp. 107–120 (1962).
Quin and Hobbs, *Anal. Chem.*, vol. 30, pp. 1400–1405 (1958).
Dickens and Black, *Rept. Brit. Empire Cancer Campaign*, vol. 42 (2) pp. 157–158 (1964).
Court et al., *J. Chroma. Sci.*, vol. 16, pp. 314–317 (1978).
Sakuma et al., *Beitr. Tabak.*, vol. 12, pp. 63–71 (1983).

CIGARETTE

REFERENCE TO RELATED APPLICATION

This is a continuation-in-part of U.S. patent application Ser. No. 012,922, filed Feb. 10, 1987, the disclosure of which is incorporated by reference.

BACKGROUND OF THE INVENTION

The present invention relates to cigarettes and other such type of smoking articles, and in particular to those smoking articles having an organic acid additive incorporated therein.

Cigarettes are popular smoking articles which have a substantially cylindrical rod shaped structure and include a charge of tobacco (i.e., in cut filler form) surrounded by a wrapper such as paper thereby forming a tobacco rod. Currently, popular cigarettes include blends of tobacco materials, the majority of the blends having nicotine contents in the range from about 1.2 percent to about 2.25 percent, more frequently from about 1.4 percent to about 2 percent, and most frequently from about 1.6 percent to about 1.8 percent, based on the dry weight of the tobacco materials. It has become desirable to manufacture cigarettes having cylindrical filters aligned in an end-to-end relationship with the tobacco rod. Typically, filters are manufactured from fibrous materials such as cellulose acetate and are attached to the tobacco rod using a circumscribing tipping material.

Popular cigarettes classified as "full flavor" cigarettes deliver a desirable tobacco taste, flavor and satisfaction to the smoker. Typically, the "full flavor" cigarettes deliver about 14 mg or more of FTC "tar" per cigarette. A second classification of popular cigarettes is the "full flavor low tar" classification. Typically, the "full flavor low tar" cigarettes deliver from about 8 to about 14 mg of FTC "tar" per cigarette, as well as lower levels of FTC nicotine as compared to "full flavor" cigarettes. A third classification of popular cigarettes in the "ultra low tar" classification. Such "ultra low tar" cigarettes deliver still lower levels of FTC "tar" and nicotine. Typically, the "ultra low tar" cigarettes deliver less than about 7 mg of FTC "tar" per cigarette. The "full flavor low tar" and "ultra low tar" cigarettes conventionally have air dilution means such as laser perforations provided in the periphery of the mouthend region thereof, or have filter elements highly efficient for the removal of "tar" and nicotine from the mainstream aerosol.

In general, the perceived taste or strength of the cigarettes classified as having lower levels of "tar" and nicotine are progressively less than that of the cigarettes which are classified as approaching the characteristics of the "full flavor" cigarettes. It has been proposed to add numerous flavorants to the cut filler of lower "tar" cigarettes to enhance the taste, strength and satisfaction of such cigarettes. However, such addition generally yields mainstream smoke which may be perceived as harsh or irritating to the mouth, nose and throat of the user.

Additionally, it is possible to employ tobaccos having a naturally high nicotine content as cut filler to enhance the tobacco taste, strength and satisfaction of such cigarettes. However, cigarettes having high nicotine contents (eg., which include tobacco blends having natural nicotine contents above about 2.25 weight percent) generally have the propensity to yeild unpalatable mainstream smoke which may be perceived as harsh or irritating to the mouth, nose and throat of the user.

It would be desirable to provide a cigarette such as an "ultra low tar" cigarette which is capable of delivering a good tobacco taste, strength and smoking satisfaction characteristic of a "full flavor low tar" cigarette while being perceived as palatable but not as overly harsh or irritating. In addition, it would be desirable to provide a cigarette such as a "full flavor low tar" cigarette which is capable of delivering a good tobacco taste, strength and smoking satisfaction characteristic of a "full flavor" cigarette while being perceived as palatable but not as overly harsh or irritating. Furthermore, it would be desirable to improve the smoking character of cigarettes which employ tobaccos or other tobacco materials having a wide range of nicotine contents.

SUMMARY OF THE INVENTION

The present invention relates to a smoking article which delivers good tobacco taste while being capable of delivering relatively low amounts of FTC "tar." Preferred articles of this invention are cigarettes which deliver taste, strength and smoking satisfaction characteristic of "full flavor" cigarettes, and relatively low levels of FTC "tar" characteristic of "full flavor low tar" cigarettes. Also preferred are cigarettes which deliver taste, strength and smoking satisfaction characteristic of "full flavor low tar" cigarettes, and relatively low levels of FTC "tar" characteristic of "ultra low tar" cigarettes. In addition, the preferred cigarettes are extremely palatable and provide the perception of having a smooth smoking character (i.e., not providing a perceived harsh or irritating character) relative to a comparable cigarette delivering similar levels of FTC "tar." Of particular interest are cigarettes having (i) relatively low FTC "tar" to FTC nicotine ratios, (ii) relatively low FTC carbon monoxide to FTC nicotine ratios, (iii) good tobacco flavor, strength and satisfaction, and (iv) a smooth, palatable smoking character without being overly mild tasting.

A cigarette in accord with this invention includes smokable (eg., tobacco) material and at least one organic acid additive. For example, a cigarette of this invention can have (i) a nicotine content above about 2 percent, based on the dry weight of the smokable material thereof; and (ii) at least one organic acid which is an additive to the cigarette in an amount of greater than about 1 pecent, based on the dry weight of the smokable material. Generally, the organic acid is an additive to at least a portion of the smokable material. The acid can be present within the cigarette in a dissociated and/or nondissociated form. A preferred organic acid additive is levulinic acid, and can be present within the cigarette as levulinic acid and/or levulinate ion.

As used herein, the term "dry weight" in referring to the smokable material of the smoking article is meant the mass of the smokable material after being dried to constant weight at 214° F. (101° C.) for 3 hours in a force-draft oven. See, Moseley et al, *Ind. Eng. Chem.*, Vol. 43, p. 2342 (1951).

As used herein, the term "nicotine content" in referring to the smokable material is meant the mass alkaloid nicotine as analyzed and quantitated by spectroscopic techniques divided by the dry weight of the smokable material analyzed. See, Harvey et al, *Tob. Sci.*, Vol. 25, p. 131 (1981).

The smokable material from which cigarettes of this invention are manufactured conveniently can be a cut filler material composed of one or more tobacco materials having a naturally high nicotine content. The naturally high nicotine content tobacco material(s) can be employed alone or as blends with (i) one or more tobacco materials having low nicotine contents, and/or (ii) one or more tobacco substitutes. As such, cigarettes of this invention include those cigarettes wherein the smokable material thereof exhibits a total nicotine content or blend nicotine content above about 2 percent.

A cigarette in accord with this invention conveniently can have incorporated therein at least one salt provided from nicotine and an organic acid. The salt is incorporated within the cigarette as an additive. Preferably, the salt is such that the molar ratio of nicotine to organic acid therein is 1:3. Most preferably, the salt additive includes nicotine levulinate. The particular salt is incorporated into the cigarette in such a manner that during use of the cigarette, the salt is subjected to decomposition conditions. For example, a cigarette of this invention can include a smokable material as well as at least one salt of nicotine and an organic acid as an additive, wherein (i) the nicotine content of the cigarette is above about 2 percent, based on the dry weight of the smokable material, and (i) one of the aforementioned salts is nicotine levulinate.

The presence of the nicotine/organic acid salt within the cigarette provides improved tobacco taste, strength and smoking satisfaction as well as improved or maintained flavor characteristics to the aerosol during use of the article.

Preferred cigarettes of this invention do not exhibit undesirable off-tastes during use.

DETAILED DESCRIPTION OF THE PREFERRED EMBODIMENTS

Figure 1:
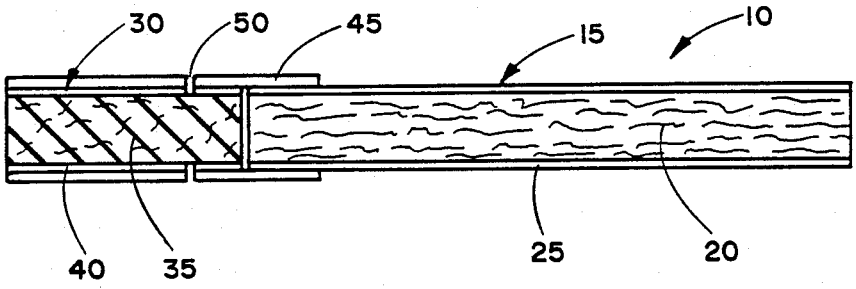
FIG. 1 is a longitudinal section view of a cigarette of this invention.

One embodiment of this invention is shown in FIG. 1 and has the form of a cigarette 10. The cigarette includes a generally cylndrical rod 15 of smokable material 20, such as tobacco cut filler, contained in circumscribing outer wrapping material 25. The rod 15 is hereinafter referred to as a "tobacco rod." The ends of the tobacco rod are open to expose the smokable material. The cigarette 10 also includes a filter element 30 positioned adjacent one end of the tobacco rod 15 such that the filter element and tobacco rod are axially aligned in an end-to-end relationship, preferably abutting one another. Filter element 30 has a generally cylindrical shape, and the diameter thereof is essentially equal to the diameter of the tobacco rod. The ends of the filter element are open to permit the passage of air and smoke therethrough. The filter element 30 includes filter material 35 which is overwrapped along the longitudinal extending surface thereof with circumscribing plug wrap material 40.

The filter element 30 is attached to the tobacco rod 15 by tipping material 45 which circumscribes both the entire length of the filter element and an adjacent region of the tobacco rod. The inner surface of the tippng material 45 is fixedly secured to the outer surface of the plug wrap 40 and the outer surface of the wrapping material 25 of the tobacco rod, using a suitable adhesive. If desired, a ventilated or air diluted cigarette is provided with an air dilution means such as a series of perforations 50 each of which extend through the tipping material and plug wrap.

Typically, the tobacco rod has a length which ranges from about 50 mm to about 85 mm, a circumference of about 17 mm to about 27 mm; and the wrapping material thereof is a conventional cigarette wrapping paper. Suitable cigarette wrapping papers are commercially available as Reference Nos. 719 and 856 from Kimberly-Clark Corp. or as Ecusta Experimental Nos. TOD 01788 and TOD 03363 from Ecusta Corp. If desired a dual wrapper system can be employed. The tobacco rods and the resulting cigarettes can be manufactured in any known configuration using known cigarette making techniques and equipment.

Typically, the filter element has a length which ranges from about 20 mm to about 35 mm and a circumference of about 17 mm to about 27 mm. The filter material can be any suitable material such as cellulose acetate, polypropylene, tobacco material, or the like. Filter materials having compositions or characteristics so as to exhibit low nicotine filtration efficiencies can be employed. The plug wrap typically is a conventional paper plug wrap, and can be either air permeable or essentially air impermeable. However, if desired, a non-wrapped cellulose acetate filter element can be employed. The various filter elements suitable for use in this invention can be manufactured using known cigarette filter making techniques and equipment.

Typically, the tipping material circumscribes the filter element and an adjacent region of the tobacco rod such that the tipping material extends about 3 mm to about 6 mm along the length of the tobacco rod. Typically, the tipping material is a conventional paper tipping material. The tipping material can have a porosity which can vary. For example, the tipping material can be essentially air impermeable, air permeable, or be treated (eg., by mechanical or laser perforation techniques) so as to have a region of perforations, openings or vents thereby providing a means for providing air dilution to the cigarette. The total surface area of the perforations and the positioning of the perforations along the periphery of the cigarette can be varied in order to control the performance characteristics of the cigarette.

As used herein, the term "air dilution" is the ratio (generally expressed as a percentage) of the volume of air drawn through the air dilution means to the total volume of air and aerosol drawn through the cigarette and exiting the extreme mouthend portion of the cigarette. For air diluted or ventilated cigarettes of this invention, the amount of air dilution can vary. Preferably, the amount of air dilution for a cigarette is greater than about 20 percent, more preferably greater than about 30 percent. The upper limit of air dilution for a cigarette typically is less than about 80 percent, more frequently less than about 60 percent.

The smokable material employed in the manufacture of the tobacco rod can vary. For example, the tobacco material can be engineered in a processed form such as an extruded form (eg., as a foamed extruded rod or extruded into a tubular shape), have the form of filler such as tobacco cut filler, or the like. Generally, the tobacco material of cigarettes has the form of cut filler. As used herein, the terms "filler" or "cut filler" are meant to include tobacco materials which have a form suitable for use in the manufacture of cigarette tobacco rods. As such, filler can include tobacco materials which are blended and are in a form ready for cigarette manufacture. The tobacco filler materials conventiently are employed in the form of strands or shreds as is common in conventional cigarette manufacture. For example, the tobacco cut filler material can be employed in the form of strands cut into widths ranging from about 1/25 inch to about 1/60 inch, preferably from about 1/30 inch to about 1/40 inch. Generally, such strands have lengths which range from about 0.25 inch to about 3 inches.

Tobacco materials can be cased and top dressed as is conventional performed during various stages of cigarette manufacture. For example, additives such as flavorants and humectants can be applied to the tobacco material as is commonly done when cigarettes are manufactured. Suitable additives include flavorants such as vanillin, cocoa, licorice, methaol, tobacco aroma oils, tobacco extracts, and the like. Such additives conventiently are applied to the smokable material as top dressing components.

The majority of the filler material present in the smokable rod is a tobacco material. However, the tobacco material can be blended with another smokable material such as a tobacco substitute material. Examples of suitable tobacco materials include flue-cured, Burley, Maryland or Oriental tobaccos; processed tobacco materials such as expanded tobaccos, processed tobacco stems, reconstituted tobacco materials or reconstituted tobacco materials having varying levels of endogenous and exogenous nicotine; or blends thereof. If desired, the tobacco materials can be blended with small amounts of carbonized and/or pyrolyzed materials.

Tobacco material(s) having a naturally high nicotine content conveniently constitute at least a portion of the smokable filler material useful in manufacturing smoking articles of this invention. Typically, such useful high nicotine content tobaccos or high nicotine content processed tobaccos have nicotine contents of above about 2.5 percent. The nicotine contents of high nicotine tobacco materials oftentimes are above about 3 percent, frequenlty above about 4 percent, and in certain circumstances above about 5 percent. Generally, the nicotine content of tobacco materials useful in this invention does not exceed about 10 percent.

The high nicotine content filler material can vary. For example, tobaccos designated by the U.S.D.A. as Type 35 (One Sucker), Type 36 (Green River) or Type 37 (Virginia Sun Cured) are common tobaccos having a naturally high nicotine content. A cultivar such as *Nicotiana rustica* often has a natural nicotine content in the range of about 6 percent to about 10 percent. Additionally, also useful are upper stalk leaves of commercial lines of flue-cured tobacco (designated by the U.S.D.A. as Types 11–14) and Burley tobacco (designated by the U.S.D.A. as Type 31). The natural nicotine content of many tobaccos can depend upon the agronomic conditions under which the tobaccos are grown as well as the particular genetic line of the tobacco.

Processed tobacco materials can be employed. Such processed tobaccos can be provided using tobacco reconstitution-type processes. For example, materials can be manufactured using extrusion, cast sheet, fourdrinier or paper making processes. Raw materials used in manufacturing processed tobaccos can include those high nicotine tobaccos described hereinbefore; or various types of tobacco extracts can be employed in the manufacturing steps of the processed tobaccos. Alternatively, processed tobaccos can be manufactured under conditions suitable to provide products having various nicotine levels. If desired, nicotine can be incorporated into the expansion solvents used to provide a volume expanded processed tobacco material having a high nicotine content. A typical expansion process is described in U.S. Pat. No. 3,524,451 to Fredrickson. Also, processed tobacco materials include tobaccos or tobacco materials mixed, blended or otherwise treated with tobacco extracts, spray dried tobacco materials or tobacco aroma oils. As such, the processed tobacco materials have high nicotine contents upon completion of the processing steps involved in their preparation or manufacture, and prior to their use in the manufacture of cigarettes.

High nicotine tobacco(s) and/or high nicotine processed tobacco(s) can be employed as the tobacco material of the cigarette, as the component(s) of cigarette blends or as portions of the components of cigarette blends. For example, the high nicotine tobacco(s) and/or high nicotine processed tobacco material(s) can be blended with tobacco substitute(s) and/or tobacco material(s) having nicotine contents of less than about 2 percent. Typically, the so-called "American blends" having high nicotine contents (i.e., total blend nicotine contents above about 2 percent) are desirable for cigarette manufacture. Typical total nicotine contents of the tobacco material or blends of materials from which tobacco rods for cigarettes of this invention are manufactured are greater than about 2.25 percent, generally greater than 2.5 percent, often greater than about 3 percent, frequently greater than about 3.5 percent, and in certain circumstances greater than about 4 percent.

Organic acids useful herein are any organic acids or organic compounds that behave as Lewis acids when contacted with nicotine. Examples of organic acids useful in practicing the present invention are aromatic acids including benzoic-type acids and substituted benzoic-type acids, hydroxyacids, heterocyclic acids, terpenoid acids, sugar acids such as the pectic acids, amino acids, cycloaliphatic acids, dicarboxylic acids, aliphatic acids, keto acids, and the like. Preferred organic acids are the straight-chain and branched-chain aliphatic acids, more preferably the aliphatic monocarboxylic acids, and especially the keto aliphatic monocarboxylic acids. Examples of suitable organic acids include formic, acetic, propionic, isobutyric, butyric, alpha-methylbutyric, isovaleric, beta-methylvaleric, caproic, 2-furoic, phenylacetic heptanoic, octanoic, nonanoic, malic, citric, oxalic, malonic, glycolic, succinic, ascorbic, tartaric, fumaric and pyruvic acid, as well as the lower fatty acids (i.e., having carbon chains less than $C_{12}$) and the higher fatty acids (i.e., having carbon chains of $C_{12}$ to $C_{20}$), and other such acids. The most preferred organic acid is a gamma keto aliphatic acid known as levulinic acid ($CH_3COCH_2CH_2COOH$). Levulinic acid also is known as acetylpropionic acid, alpha-ketovaleric acid and 4-oxypentaoic acid. Useful organic compounds which exhibit an acid character include the phenolics such as guaiacol, vanillin, protocatechualdehyde, and the like.

Numerous organic acids can improve the flavor or aroma of the aerosol, as numerous organic acids are suitable flavorants. However, whether a particular organic acid acts as a flavorant depends upon the amount of the particular organic acid employed as an additive as well as the flavor threshold of the particular acid employed. See, for example, *Tobacco Flavoring For Smoking Products,* by Leffingwell et al, p. 11 to 15 (1972).

However, it may be desirable to use organic acids which provide specific flavor characteristics to the cigarette at low amounts in order to not provide undesirable off-tastes or aromas to the cigarette. For example, it may be desirable to employ certain organic acids at low enough levels in order that the cigarette does not exhibit taste or aroma characteristics which can be perceived as being chemical, metallic, bitter, pungent or soapy in nature, or as being dissonant to the general organoleptic characteristics associated with tobacco smoke.

The most preferred organic acid is levulinic acid. Such an organic acid can provide a smooth, palatable character to the cigarette while not providing any significant dissonant taste or aroma. If desired, certain amounts of various other organic acids can be blended with levulinic acid and employed as the additive of this invention. For example, it is desirable that a majority of the organic acid additive be levulinic acid.

The organic acid additive can be incorporated into the cigarette in a variety of places or sites. For example, the organic acid or organic acid mixture can be applied to the filler material, incorporated within some or all of the filler material, applied to the wrapper of the tobacco rod, applied within the glue line of the wrapper of the tobacco rod, provided within the filter element of the cigarette, or the like. If desired, the organic acid additive can be incorporated into processed tobaccos during the manufacture of such materials. For example, the organic acids can be mixed with tobacco extracts or tobacco aroma oils, and the resulting tobacco material-/organic acid mixture can be blended with, mixed with, or otherwise used to treat other tobacco(s) or tobacco material(s). The organic acid can be applied to the cigarette or be present within the cigarette in nondissociated form and/or in a dissociated (eg., carboxylate) form.

Typically, the organic acid additive is incorporated in the cigarette by admixing the additive with the tobacco material. The manner or process for applying the additive can vary depending upon whether the additive is applied diluted in liquid form, or upon the positioning of the additive within the cigarette. For example, the additive can be applied using syringes or techniques such as spraying, casing, electrostatic deposition, impregnation, garniture injection, spray drying, inclusion and encapsulation techniques, and the like.

Suitable solvents for the organic acids include water, ethanol, glycerol, propylene glycol, and the like, as well as combinations thereof.

One or more salts provided from nicotine and an organic acid can be incorporated into the cigarette. The use of such salts can provide for a cigarette having a relatively high nicotine content as well as provide the organic acid additive. Such salts can be incorporated into cigarettes which include tobacco materials having a wide range of nicotine contents.

Preferred nicotine/organic acid salts have a molar ratio of organic acid to nicotine of 1:1, 2:1 or 3:1, most preferably 3:1. The most preferred salts are totally ionized salts of nicotine and the organic acid. Such preferred ionized salts are those salts wherein both of the nicotine nitrogen atoms are ionized by the acid hydrogens of the organic acids. For example, a particularly preferred salt is provided from 1 mole of nicotine and 3 moles of levulinic acid and has a molar ratio thereof of 1:3.

The nicotine/organic acid salts conveniently are prepared using techniques generally known to those skilled in the art. Many of such techniques have been catalogued by Perfetti in *Beitrage Zur Tabakforschung International,* Vol. 12, No. 2, p. 43 (1983), which is incorporated herein by reference. Preferably, nicotine/organic acid salts are provided by contacting nicotine with at least the stoichiometric amount of the organic acid necessary to form the particular salt under conditions sufficient to form the salt.

The preferred salts provided from nicotine and the organic acid generally are essentially non-volatile at conditions under which the smoking articles are manufactured and stored, however, specific properties of the various salts can vary. For example, nicotine/organic acid salts having straight-chain or branched-chain aliphatic acids having less than 20 carbon atoms generally have a molar ratio of 1:3 (nicotine:acid), and generally are liquid in form at ambient conditions. Such salts typically decompose at temperatures less than 100° C., usually in the range from about 50° C. to about 60° C. As another example, nicotine/organic acid salts having dicarboxylic organic acids generally have a molar ratio of 1:2 (nicotine:acid), and generally are solid in form at ambient conditions. Such salts typically decompose at temperatures in the range from about 90° C. to about 120° C. As yet another example, nicotine/organic acid salts having acids containing phenyl groups generally have molar ratios of 1:1, 1:2 or 1:3 (nicotine:acid). Generally such salts are solid in form at ambient conditions. Such salts typically decompose at temperature in the range from about 110° C. to about 200° C.

Numerous nicotine/organic acid salts can improve the flavor or aroma of the aerosol, as numerous organic acids are suitable flavorants. Examples of salts which can provide flavor and aroma to the mainstream aerosol at certain levels include nicotine acetate, nicotine oxalate, nicotine malate, nicotine isovalerate, nicotine lactate, nicotine citrate, nicotine phenylacetate and nicotine myristate. However, it may be desirable to use salts which provide flavor characteristics to the cigarette at low amounts in order to not provide undesirable off-tastes or aromas to the cigarette.

The most preferred nicotine/organic acid salt is nicotine levulinate. Such a salt can provide a smooth, palatable character to the cigarette while not providing any significant dissonant taste or aroma. If desired, certain amounts of various nicotine/organic acid salts can be blended with nicotine levulinate and employed as the additive to provide cigarettes of this invention.

The salts can be incorporated into the cigarette in a variety of places or sites. For example, the salt can be applied to the filler material, incorporated within some or all of the filler material, applied to the wrapper of the tobacco rod, applied within the glue line of the wrapper of the tobacco rod, applied within a region (eg., a cavity) which is subjected to heat, or the like.

Typically, the nicotine/organic acid salt additive or additive mixture is incorporated in the cigarette by admixing the additive with the tobacco material. the manner or process for applying the additive can vary depending upon whether the additive is applied in solid or liquid form, or upon the positioning of the additive within the cigarette. For example, the additive can be applied using syringes or techniques such as spraying, electrostatic deposition, impregnation, garniture injection, spray drying, inclusion and encapsulation techniques, and the like.

When the nicotine/organic acid salts are applied using spraying techniques it is desirable to form a liquid solution of the salt in a suitable solvent. Such solutions should exhibit a low enough viscosity to allow for spraying or injecting the solution. However, it is desirable that the concentration of the salt within the solution not be so dilute that the salt experiences significant dissociation. Typically, the concentration of salt within the solution is about 20 weight percent or more.

Suitable solvents for the salts include water, ethanol, glycerol, propylene glycol, and the like, as well as combinations thereof. Generally, most nicotine/organic acid salts are soluble or miscible in such solvents, and the salts do not undergo substantial dissociation when solubilized to small amounts. For example, the salt can be hydrated in water without undergoing a significant amount of dissociation. However, salts diluted with substantial amounts of solvent can undergo dissociation to some degree to provide for the application of a mixture of nicotine/organic acid salt, nicotine and organic acid to the cigarette. Thus, it is possible to apply an additive in the form of nicotine and levulinic acid to the cigarette.

If desired, cigarettes can have incorporated therein as an additive (i) at least one salt consisting of nicotine and an organic acid, and (ii) nicotine. Preferred additives of such type include at least one salt having a molar ratio of nicotine to organic acid of 1:3.

The amount of organic acid employed within the cigarette can vary. The amount of organic acid incorporated within the cigarette depends upon factors such as the placement of the organic acid within the cigarette, and the configurational aspects of the cigarette. Configurational aspects include the composition and characteristics of the filter material and initial filler blend, the degree of ventilation of the cigarette, and other such factors. For example, for most cigarettes of this invention comprising tobacco material having a total or blend nicotine content of from about 2 percent to about 10 percent, it frequently is desirable to provide organic acid additive to the cigarette in an amount from about 1 percent to about 10 percent, based on the dry weight of the tobacco filler material in order to provide acceptable tobacco taste, strength and satisfaction upon use. Generally, the amount of organic acid applied to such a cigarette is greater than about 2 percent, and oftentimes greater than about 3 percent, based on the dry weight of the tobacco filler materal within the cigarette.

The amount of nicotine/organic acid salt or salts employed within the cigarette can vary. The amount of salt incorporated within the cigarette depends upon factors such as the placement of the salt within the cigarette, and the configurational aspects of the cigarette. For most cigarettes having tobacco filler material comprising a nicotine content of from about 1 percent to about 2 percent, it frequently is desirable to provide salt additive to provide a total nicotine content of up to about 8 percent, more frequently up to about 4 percent to the cigarette. Such an amount of additive can provide for good tobacco taste, strength and satisfaction upon use. Generally, the amount of nicotin/organic acid salt applied to a typical cigarette provides from about 0.25 percent to about 20 percent, preferably from about 1.2 to about 13 percent of salt additive, based on the dry weight of the tobacco filler material within that cigarette. In certain instances, it is desirable to employ about 3.5 percent of salt additive or more, based on the dry weight of the tobacco filler material within the cigarette.

The cigarettes of this invention preferably provide a mainstream aerosol exhibiting a pH which is essentially equal to or less than that of a similar cigarette having a low amount (e.g., less than about 0.2 weight percent) of the organic acid additive incorporated therein. In certain circumstances, an amount of organic acid additive is incorporated into a cigarette in order to reduce the pH of the mainstream aerosol during use thereof. Mainstream aerosol is that aerosol which is drawn through the article and into the mouth of the user. For example, for a cigarette having smokable tobacco material contained in a circumscribing outer wrapping material, the mainstream aerosol is the mainstream tobacco smoke which includes the combustion and/or pyrolysis products of tobacco material.

By the term, "pH of mainstream aerosol" is meant that averaged per-puff pH of the whole aerosol as measured using the techniques described by Sensabaugh et al in *Tobacco Science,* Vol. XI, pp. 25–30 (1967), which is incorporated herein by reference. Typical mainstream aerosol pH for a cigarette ranges from about 4.5 units to about 8.5 units on average per cigarette.

In referring to a reduction in the pH of mainstream aerosol, it is meant a lowering of the average pH of the mainstream aerosol per particular cigarette. Such reduction is provided by the addition of an effective amount of the additive (eg., organic acid additive and/or nicotine/organic acid salt). Typically, the reduction in pH is a lowering of the pH by more than about 0.03 pH unit; preferably by more than about 0.08 pH unit. Typically, reduction in the pH of the mainstream aerosol does not provide a cigarette which yields mainstream aerosol having a pH significantly below 4.5 units.

The presence of the organic acid (which can be provided by the decomposition of the nicotine/organic acid salt during use of the cigarette can introduce a reduction of the pH of the mainstream aerosol depending upon the quantity and type of organic acid which is incorporated therein. Thus, a certain balance, mellowing or marrying of the flavors culminate in a fully bodied tobacco flavor, strength and satisfaction which is delivered to the user. Such a flavor enhancing characteristic is particularly desirable for highly air diluted or "ultra low tar" cigarettes.

The pH of the mainstream aerosol is influenced by a number of factors. For example, the pH of mainstream cigarette smoke can be influenced by factors such as the type of tobacco material or blend of tobacco materials employed, the type of processed tobacco (e.g., volume expanded tobacco or reconstituted tobacco), the configuration of the cigarette (eg., the filter tow material, the degree of air dilution, the circumference of the cigarette, the type of wrapping material, etc.), the manner of drawing on or puffing the cigarette, and other such factors.

Cigarettes of this invention generally deliver from about 0.2 mg to about 3.5 mg, frequently from about 0.3 mg to about 2.5 mg, more frequently from about 0.4 mg to about 1.5 mg of nicotine when smoked under FTC conditions. Typically, FTC "tar" to FTC nicotine ratios for cigarettes of this invention are less than about 12, generally less than about 9, frequently less than about 7, and in certain instances less than about 5. FTC "tar" to FTC nicotine ratios for cigarettes of this invention often can range from about 3 to about 6. Typically, the FTC "tar" to FTC nicotine ratios of a cigarette having a nicotine/organic acid salt incorporated therein can be lowered by up to about 80 percent of that ratio of similar cigarette not having the salt additive incorporated therein.

The following examples are provided in order to further illustrate the invention but should not be construed as limiting the scope thereof. Unless otherwise noted, all parts and percentages are by weight.

EXAMPLE 1

A salt of nicotine and levulinic acid is provided using the following procedure.

Into a 1,000 ml round bottom flask is charged about 350 g of 1-nicotine provided from Kodak Laboratory Chemicals, Eastman Kodak Co. (Catalogue No. 52, p. 366, Chemical No. 1124973). To the 1-nicotine is charged about 10 g of sodium hydroxide pellets. The flask is fitted with a heating mantle and equipped with a magnetic stirring bar. The nicotine solution is stirred employing a magnetic stirring unit. The nicotine is vacuum distilled using a Todd Column packed with glass helixes, and the fraction distilled between 97° C. and 98° C. at 10 mm Hg pressure is collected at a reflux ratio of about 10:1. The collected distillate is water clear. The nicotine so purified using the vacuum distillation technique is employed in the preparation of the 1-nicotine/-levulinic acid salt.

Into a 500 ml round bottom flask equipped with a magnetic stirring bar and heating mantle is charged 69.6 g (0.6 mole) of levulinic acid. The levulinic acid is stripped employing a conventional magnetic stirring unit. The levulinic acid is obtained from Aldrich Chemical Co., Catalogue No. 1984–85, p. 672, Compound No. L-200-9, and is employed without further purification. The levulinic acid is heated to about 50° C. in order to provide a liquid form thereof, and the liquified component is subjected to stirring. To the liquified levulinic acid is titrated 32.4 g (0.2 mole) of the purified 1-nicotine over about a 20 minute time period. It is preferred to introduce the nicotine to the organic acid in order to provide an environment of excess acid to nicotine and thus promote the formation of salt. A clear, viscous yellow colored material weighing about 100 g results. The product is sealed in a glass ampuole under nitrogen.

The product is 1-nicotine levulinate (as determined using infrared spectrometry), and has a nicotine to levulinic acid ratio of 1:3 (as determined by a destructive distillation in a 10 percent sodium hydroxide aqueous solution, subsequent extraction using isopropanol, and gas chromatographic analysis for nicotine). The salt is believed to have a structure substantially as generally described in FIG. 13 of the Perfetti reference, supra.

Cigarettes incorporating varying amounts of the 1-nicotine levulinate salt are provided using the following procedure.

Cigarettes having lengths of about 99 mm and circumferences of about 24.85 mm have tobacco rod lengths of 68 mm and filter element lengths of 31 mm. The tobacco rod includes a charge of tobacco cut filler weighing about 0.74 g contained in a circumscribing cigarette paper wrap which is sold commercially as 754 Cigarette Paper by Ecusta Corp. The filter element is manufactured using conventional cigarette filter making technology from cellulose acetate tow (2.7 denier per filament, 48,000 total denier) and circumscribing air permeable paper plug wrap having a CORESTA porosity of 26,000 cm/min. The tobacco rod and filter element are aligned in an abutting, end-to-end relationship and secured together using tipping paper having a CORESTA porosity of 3135 ml/min. The tipping paper is adhesively secured to the filter element and the adjacent portion of the tobacco rod. The tipping material circumscribes the length of the filter element and about 3 mm of the length of the tobacco rod. Cigarettes so described are manufactured using a Pilot Cigarette Maker from Hauni-Werke Korber & Co. KG. A ring of mechanically provided perforations extends around the periphery of the cigarette about 13 mm from the extreme mouthend thereof. The perforations so provided yield cigarettes which are 50 percent air diluted. The cigatettes so manufactured are designated Sample Nos. 1, 2, 3 and C-1, corresponding to the sample of filler material from which each cigarette is manufactured.

The filler material employed in providing the tobacco rod is in the form of strands cut at about 32 cuts per inch. The initial filler material includes a blend of about 9 percent Burley tobacco, about 41 percent flue-cured tobacco, about 32 percent reconstituted tobacco material, and about 18 percent Oriental tobaccos. The blend has an aqueous casing of glycerin and flavors applied thereto.

Four lots of the cut filler blend, each lot weighing 1,520 g, are provided. The first lot is treated with 20 g of the 1-nicotine levulinate additive. The second lot is treated with 60 g of the 1-nicotine levulinate additive. The third lot is treated with 100 g of the 1-nicotine levulinate additive. The fourth lot is not treated with the 1-nicotine levulinate additive and is employed for comparison purposes.

The 1-nicotine levulinate additive is applied to cut filler as a spray using a hand sprayer to apply a 1:1 mixture of water and additive.

Each of the four lots are separately placed in sealed plastic bags and stored at 70° F. for 2 days. Then, the four lots are each mixed with about 480 g of a cut filler mixture of about 75 parts volume expanded Burley tobacco and about 25 parts volume expanded flue-cured tobacco. The volume expanded cut filler mixture is added to each lot using a mixing drum in order to provide a well mixed blend having a moisture content of about 12 percent to about 13 percent. The resulting blend provided from the first lot of filler material has about 1 percent of the 1-nicotine levulinate salt applied thereto (based on the filler conditioned weight) and is designated as Sample No. 1. The resulting blend provided from the second lot of filler material has about 3 percent of the 1-nicotine levulinate salt applied thereto (based on the filler conditioned weight) and is designated as Sample No. 2. The resulting blend provided from the third lot of filler material has about 5 percent of the 1-nicotine levulinate salt applied thereto (based on the filler conditioned weight) and is designated as Sample No. 3. The resulting blend provided from the fourth lot of filler material is not treated with the 1-nicotine levulinate salt additive, is employed for comparison purposes, and is designated as Sample No. C-1.

The various cigarettes are smoked under FTC conditions. Data concerning (i) FTC "tar," FTC nicotine and FTC carbon monoxide, (ii) the "tar"/nicotine ratio, (iii) cigarette nicotine content, (iv) puff count, and (v) pH of the mainstream aerosol for each sample are presented in Table I.

TABLE I

| Sample | FTC "tar" (mg/cigarette)[1] | FTC Nicotine (mg/cigarette)[1] | FTC CO (mg/cigarette)[1] | "Tar"/ Nicotine[2] | Total Nicotine (%)[3] | Puff Count[4] | Smoke pH[5] minimum | Smoke pH[5] maximum |
|---|---|---|---|---|---|---|---|---|
| 1 | 5.1 | 0.56 | 7.4 | 9.1 | 2.05 | 8.7 | 5.75 | 6.01 |
| 2 | 4.9 | 0.69 | 7.4 | 7.1 | 2.51 | 8.9 | 5.65 | 6.02 |
| 3 | 4.9 | 0.81 | 6.7 | 6.0 | 2.91 | 9.0 | 5.67 | 5.98 |
| C-1* | 4.6 | 0.38 | 7.5 | 12.1 | 1.66 | 8.8 | 5.85 | 6.10 |

*Not an example of the invention.
[1]FTC conditions consist of two seconds of puffing (35 ml total volume) separated by 58 seconds of smolder.
[2]"Tar"/nicotine is the ratio of FTC "Tar" to FTC nicotine delivered by the cigarette.
[3]Total nicotine is the total amount of nicotine (i.e., as nicotine present within the cigarette from all sources and based on the dry weight of the filler). See, the Harvey et al reference, supra.
[4]Puff count is the average number of puffs per cigarette provided under FTC smoking conditions.
[5]Smoke pH is determined using the techniques described in the Sensabaugh et al reference, supra. The presented minimum and maximum pH value for each cigarette are the calculated average of per-puff minimum and maximum values obtained for 8 puffs per cigarette.

The data in Table I indicate that the various cigarettes have increased nicotine contents and exhibit increased FTC nicotine values as the level of 1-nicotine levulinate is increased. In addition, the FTC "tar" to nicotine ratios for the samples decrease as the level of 1-nicotine levulinate is increased. The various cigarettes each exhibit similar "tar" deliveries, carbon monoxide deliveries and puff counts. Further, the samples of the invention (i.e., Sample Nos. 1–3) exhibit a pH of the whole smoke lower than that of the sample not having the exogenous nicotine/organic acid salt (i.e., Sample No. C-1).

Evaluations of the organoleptic properties of the Sample Nos. 2, 3 and C-1 indicate that the cigarette having about 5 percent salt additive (i.e., Sample No. 3) exhibits greater impact and smoothness as well as less harshness than the cigarette not having salt additive (i.e., Sample No. C-1). Sample No. 2 is not significantly different organoleptically from Sample No. C-1 in terms of harshness and overall taste, even through there is a substantial increase in FTC nicotine of the sample relative to the comparative sample. Thus, the nicotine levulinate additive provides for a cigarette having a relatively low FTC "tar" to FTC nicotine ratio while having a smooth (i.e., not overly harsh) taste.

EXAMPLE 2

Cigarettes incorporating varying amounts of the 1-nicotine levulinate salt are provided using the following procedure.

Cigarettes having lengths of about 84 mm and circumferences of about 24.85 mm have tobacco rod lengths of 57 mm and filter element lengths of 27 mm. The tobacco rod includes a charge of tobacco cut filler weighing about 0.49 g contained in a circumscribing cigarette paper wrap which is sold commercially as 854 Cigarette Paper by Ecusta Corp. The filter element is manufactured using conventional cigarette filter making technology from cellulose acetate tow (2.1 denier per filament, 48,000 total denier) and circumscribing non-air permeable paper plug wrapp. The tobacco rod and filter element are aligned in an abutting, end-to-end relationship and secured together using a non-air permeable tipping paper. The tipping paper is adhesively secured to the filter element and the adjacent portion of the tobacco rod. The tipping material circumscribes the length of the filter element and about 3 mm of the length of the tobacco rod. Cigarettes so described are manufactured using a Pilot Cigarette Maker from Hauni-Werke Korber & Co. KG. A ring of laser perforations are provided amound the periphery of the cigarette about 13 mm from the extreme mouthend thereof. The perforations penetrate through the tipping paper and plug wrap, and are provided using a Laboratory Laser Perforator from Hauni-Werke Korber & Co. KG. The perforated cigarette is 75 percent air diluted. The cigarettes so manufactured are designated Sample Nos. 4, 5, 6 and C-2, corresponding to the sample of filler material from which each cigarette is manufactured.

The filler material employed in providing the tobacco rod is in the form of strands cut at about 32 cuts per inch. The initial filler material includes a blend of about 43 percent burley tobacco, about 6 percent flue-cured tobacco, about 19 percent reconstituted tobacco material, and about 32 percent Turkish tobacco. The blend has an aqueous casing of glycerin and flavors applied thereto.

Four lots of the cut filler blend, each lot weighing 940 g, are provided. The first lot is treated with 60 g of the 1-nicotine levulinate additive. The second lot is treated with 140 g of the 1-nicotine levulinate additive. The third lot is treated with 200 g of the 1-nicotine levulinate additive. The fourth lot is not treated with the 1-nicotine levulinate additive and is employed for comparison purposes.

The 1-nicotine levulinate additive is applied to cut filler as a spray using a hand sprayer to apply a 1:1 mixture of water and additive.

Each of the four lots are separately placed in sealed plastic bags and stored at 70° F. for 2 days. Then, the four lots are each mixed with about 1,060 g of a cut filler mixture of about 35 parts volume expanded burley tobacco and about 65 parts volume expanded flue-cured tobacco. The volume expanded cut filler mixture is added to each lot using a mixing drum in order to provide a well mixed blend having a moisture content of about 12 percent to about 13 percent. The resulting blend provided from the first lot of filler material has about 3 percent of the 1-nicotine levulinate salt applied thereto (based on the filler conditioned weight) and is designated as Sample No. 4. The resulting blend provided from the second lot of filler material has about 7 percent of the 1-nicotine levulinate salt applied thereto (based on the filler conditioned weight) and is desiganted as Sample No. 5. The resulting blend provided from the third lot of filler material has about 10 percent of the 1-nicotine levulinate salt applied thereto (based on the filler conditioned weight) and is designated as Sample No. 6. The resulting blend provided from the fourth lot of filler material is not treated with the 1-nicotine levulinate salt additive, is employed for comparison purposes, and is designated as Sample No. C-2.

For comparison purposes, Sample No. C-3 is prepared. Sample No. C-3 is provided by adding nicotine to a cigarette designated as Sample No. C-2. In particular, about 30 mg of a 1:1 mixture of ethanol and 85 percent pure 1-nicotine is injected into the cigarette in order to provide a nicotine content of about 3.92 percent to the cigarette. The nicotine/ethanol mixture is incorporated into the tobacco rod by inserting a syringe into the lighting end of the rod and slowly pulling the syringe from the rod while injecting the mixture into the rod.

Sample No. 7 is provided by injecting about 10 mg of the previously described 1:1 mixture of ethanol nicotine into a cigarette designated as Sample No. 6 using a syringe in the manner previously described. The cigarette so provided comprises a nicotine levulinate additive as well as an exogenous nicotine additive.

The various cigarettes are smoked under FTC conditions. Data concerning (i) FTC "tar," FTC nicotine and FTC carbon monoxide, (ii) the "tar"/nicotine ratio, (iii) cigarette nicotine content, and (iv) puff count for Sample Nos. 4–6 and C-2 are presented in Table II. In addition, data concerning the pH of the mainstream aerosol for Sample Nos. 4–6, C-2 and C-3 are presented in Table II.

TABLE II

| Sample | FTC "Tar" (mg/cigarette)[1] | FTC Nicotine (mg/cigarette)[1] | FTC CO (mg/cigarette)[1] | "Tar"/ Nicotine[2] | Total Nicotine (%)[3] | Puff Count[4] | Smoke pH[5] minimum | Smoke pH[5] maximum |
|---|---|---|---|---|---|---|---|---|
| 4 | 1.8 | 0.29 | 2.9 | 6.2 | 2.64 | 6.7 | 5.90 | 6.28 |
| 5 | 2.0 | 0.39 | 3.0 | 5.1 | 3.22 | 6.8 | 5.86 | 6.20 |
| 6 | 2.0 | 0.51 | 3.1 | 3.9 | 3.92 | 6.8 | 5.91 | 6.32 |
| C-2* | 1.8 | 0.18 | 2.9 | 10.0 | 2.08 | 6.7 | 6.13 | 6.42 |
| C-3* | — | — | — | — | — | — | 6.78 | 7.11 |

*Not an example of the invention.

[1–4]See Table I, footnotes 1–4, respectively.

[5]Smoke pH is determined using the techniques described in the Sensabaugh et al reference, supra. The presented minimum and maximum pH value for each cigarette are the calculated average of per-puff minimum and maximum values obtained for a number of puffs per cigarette. For Sample Nos. 4, 5 and C-2, the number of puffs used to calculate the average pH values is 7. For Sample Nos. 6 and C-3, the number of puffs used to calculate the average pH values is 6.

The data in Table II indicate that the various cigarettes have incresed nicotine contents and exhibit increased FTC nicotine values as the level of 1-nicotine levulinate is increased. In addition, the FTC "tar" to nicotine ratios for the samples decrease as the level of 1-nicotine levulinate is increased. The various cigarettes each exhibit similar "tar" deliveries, carbon monoxide deliveries and puff counts. Further, the samples of the invention (i.e., Sample Nos. 4–6) exhibit a pH of the whole smoke lower than that of the sample not having the exogenous nicotine/organic acid salt (i.e., Sample No. C-2). In addition, the pH of the whole smoke of Sample No. C-3 is very much higher than that of any of the other samples.

Evaluations of the organoleptic properties of Sample Nos. 5, 6 and C-2 indicate that the cigarette having about 10 percent salt additive (i.e., Sample No. 6) exhibits greater impact and smoothness as well as less harshness than the cigarette not having the salt additive (i.e., Sample No. C-2). All cigarettes sampled provide good tobacco taste and do not exhibit a perceivable chemical off-taste or non-cigarette taste. Surprisingly, Sample No. 5 is not significantly different organoleptically from Sample No. C-2 in terms of impact, smoothness, harshness and overall taste even though the sample provides a higher level of FTC nicotine than the comparative sample. Sample No. C-3 is extremely harsh and is not palatable. However, Sample No. 7 surprisingly exhibits a smooth smoking character and is palatable, even though the sample has a relatively high level of exogenous nicotine incorporated therein.

EXAMPLE 3

Cigarettes having a high nicotine content and incorporating varying amounts of the levulinic acid are provided using the following procedure.

Cigarettes having lengths of about 84 mm and circumferences of about 24.85 mm have tobacco rod lengths of 57 mm and filter element lengths of 27 mm. The tobacco rod includes a charge of tobacco cut filler weighing about 0.76 g contained in a circumscribing cigarette paper wrap which is sold commercially as 854 Cigarette Paper by Ecusta Corp. The filter element is manufactured using conventional cigarette filter making technology from cellulose acetate tow (2.1 denier per filament, 48,000 total denier) and circumscribing air permeable paper plug wrap having a CORESTA porosity of 26,000 cm/min. The tobacco rod and filter element are aligned in an abutting, end-to-end relationship and secured together using porous (air permeable) tipping paper. The tipping paper is adhesively secured to the filter element and the adjacent portion of the tobacco rod. The tipping material circumscribes the length of the filter element and about 4 mm of the length of the tobacco rod. Cigarettes so described are manufactured using a Pilot Cigarette Maker from Hauni-Werke Korber & Co. KG. A ring of mechanically provided perforations extends around the periphery of the cigarette about 13 mm from the extreme mouthend thereof. The perforations so provided yield cigarettes which are 75 percent air diluted. The cigarettes so manufactured are designated Sample Nos. 8, 9, 10 and C-4, corresponding to the sample of filler material from which each cigarette is manufactured.

The filler material employed in providing the tobacco rod is in the form of strands cut at about 32 cuts per inch. The initial filler material includes a blend of about 40 percent Burley tobacco having a nicotine content of about 5 percent, about 18 percent flue-cured tobacco having a nicotine content of about 3.5 percent, about 30 percent reconstituted tobacco material having anicotine content of about 0.5 percent, and 12 percent of an Oriental tobacco blend having a nicotine content of about 0.9 percent. The blend has an aqueous casing of glycerin and flavors applied thereto.

Four lots of the cut filler blend, each lot weighing 2,000 g on a dry weight basis, are provided. The first lot is treated with 120 g of the levulinic acid additive. The second lot is treated with 280 g of the levulinic acid additive. The third lot is treated with 400 g of the levulinic acid additive. The fourth lot is not treated with the levulinic acid additive and is employed for comparison purposes.

The levulinic acid additive is applied to cut filler as a spray using a hand sprayer as a mixture of water and additive. The quantity of water of the water/additive mixture is adjusted to attain a final cut filler moisture content of about 15 percent.

Each of the four lots are separately placed in sealed plastic bags and stored at 70° F. for 2 days. Then, the four lots are each mixed with about 2,000 g on a dry weight basis, of a cut filler mixture of about 35 parts volume expanded Burley tobacco having a nicotine content of about 4 percent, and about 65 parts volume expanded flue-cured tobacco having a nicotine content of about 4 percent. The volume expanded cut filler mixture is added to each lot using a mixing drum in order to provide a well mixed blend having a moisture content of between about 12 percent and about 13 percnet.

The resulting blend provided from the first lot of filler material has about 3 percent of the levulinic acid applied thereto (based on the filler dry weight) and is designated as Sample No. 8. The resulting blend provided from the second lot of filler material has about 7 percent of the levulinic acid applied thereto (based on the filler dry weight) and is designated as Sample No. 9. The resulting blend provided from the third lot of filler material has about 10 percent of the levulinic acid applied thereto (based on the filler dry weight) and is designated as Sample No. 10. The resulting blend provided from the fourth lot of filler material is not treated with the levulinic acid additive, is employed for comparison purposes, and is designated as Sample No. C-4.

The various cigarettes are smoked under FTC conditions. Data concerning (i) the nicotine content of each blend, (ii) FTC "tar," FTC nicotine and FTC carbon monoxide, (iii) the "tar"/nicotine ratio, (iv) puff count, and (v) pH of the mainstream aerosol for each sample, are presented in Table III.

while the control sample is very harsh. The mildness of Sample Nos. 8 and 9 is considered comparable. The cigarettes of the invention yield good tobacco taste, strength and smoking satisfaction. The control sample is very strong, and the overpowering sensation provided thereby is not satisfying.

EXAMPLE 4

Cigarettes incorporating varying amounts of the levulinic acid are provided using the following procedure.

Cigarettes having lengths of about 84 mm and circumferences of about 24.85 mm have tobacco rod lengths of 57 mm and filter element lengths of 27 mm. The tobacco rod includes a charge of tobacco cut filler weighing about 0.82 g contained in a circumscribing cigarette paper wrap which is sold commercially as 856 Cigarette Paper by Ecusta Corp. The filter element is manufactured using conventional cigarette filter making technology from cellulose acetate tow (2.7 denier per filament, 48,000 total denier) and circumscribing air permeable paper plug wrap having a CORESTA porosity of about 26,000 cm/min. The tobacco rod and filter element are aligned in an abutting, end-to-end relationship and secured together using essentially air impermeable tipping paper. The tipping paper is adhesively secured to the filter element and the adjacent portion of the tobacco rod. The tipping material circumscribes the length of the filter element and about 4 mm of the length of the tobacco rod. Cigarettes so described are manufactured using a Pilot Cigarette Maker from Hauni-Werke Korber & Co. KG. A ring of laser perforations extends around the periphery of the cigarette about 13 mm from the extreme mouthend thereof. The perforations so provided yield cigarettes which are 50 percent air diluted. The cigarettes so manufactured are designated Samples Nos. 11, 12, 13 and C-5, corresponding to the sample of filler material from which each cigarette is manufactured.

TABLE III

| Sample | FTC "Tar"[1] (mg/cigarette) | FTC Nicotine[1] (mg/cigarette) | FTC CO[1] (mg/cigarette) | "Tar"/[2] Nicotine | Total[3] Nicotine (%) | Puff[4] Count | Smoke pH[5] minimum | Smoke pH[5] maximum | Average[6] Smoke pH |
|---|---|---|---|---|---|---|---|---|---|
| 8 | 1.2 | 0.27 | 2.08 | 5.22 | 3.12 | 6.7 | 6.12 | 6.41 | 6.57 |
| 9 | 1.4 | 0.23 | 2.10 | 6.09 | 3.00 | 6.7 | 6.16 | 6.30 | 6.16 |
| 10 | 1.5 | 0.23 | 2.18 | 5.56 | 2.94 | 6.8 | 5.48 | 5.82 | 5.20 |
| C-4* | 1.2 | 0.21 | 2.04 | 5.71 | 3.08 | 6.7 | 6.47 | 6.82 | 6.79 |

*Not an example of the invention.
[1-4]See Table I, footnotes 1-4, respectively.
[5]Smoke pH is determined using the techniques described in the Sensabaugh et al reference, supra. The presented minimum and maximum pH value for each cigarette are the calculated average of per-puff minimum and maximum values obtained for 7 puffs per cigarette.
[6]Average smoke pH is the "twenty port" smoke pH for the mainstream smoke of 20 cigarettes as determined using techniques described by Harris et al, 32nd Tob. Chem. Res. Conf., (1978).

The data in Table III indicate that the various cigarettes having high nicotine content cut filler (i.e., approximately 3 percent total blend nicotine) exhibit comparable FTC "tar," nicotine and carbon monoxide deliveries, as well as comparable FTC "tar" to FTC nicotine ratios and puff counts. However, cigarettes of the invention (i.e., Sample Nos. 8-10 which contain the levulinic acid additive) exhibit reduced mainstream by puff and average smoke pH when compared to a control (i.e., Sample No. C-4 which does not have the levulinic acid additive). In addition, the data indicate that the smoke pH of cigarettes of the invention is reduced significantly as the level of levulinic acid additive increases. The reduction in the smoke pH of the samples of the invention is indicative of a substantial increase in the hydronium ion concentration of the tobacco smoke. Such an increase in the hydronium ion concentration of the mainstream smoke is sufficient to provide a change in the organoleptic quality of the smoke.

Organoleptic evaluation of the samples indicates that the cigarettes of the invention are smooth smoking The filler material employed in providing the tobacco rod is in the form of strands cut at about 32 cuts per inch. The initial filler material includes a blend of about 31 percent Burley tobacco having a nicotine content of about 5 percent, about 20 percent flue-cured tobacco having a nicotine content of about 3.5 percent, about 31 percent reconstituted tobacco material having a nicotine content of about 0.5 percent, and 18 percent of an Oriental tobacco blend having a nicotine content of about 0.9 percent. The blend has an aqueous casing of glycerin and flavors applied thereto.

Four lots of the cut filler blend, each lot weighing 3,120 g on a dry weight basis, are provided. The first lot is treated with 40 g of the levulinic acid additive. The second lot is treated with 120 g of the levulinic acid additive. The third lot is treated with 200 g of the levulinic acid additive. The fourth lot is not treated with the levulinic acid additive and is employed for comparison purposes.

The levulinic acid additive is applied to cut filler as a spray using a hand sprayer as a mixture of water and additive. The quantity of water of the water/additive mixture is adjusted to attain a final cut filler moisture content of about 15 percent.

Each of the four lots are separately placed in sealed plastic bags and stored at 70° F. for 2 days. Then, the four lots are each mixed with about 880 g on a dry weight basis, of a cut filler mixture of about 35 parts volume expanded Burley tobacco having a nicotine content of about 4 percent, and about 65 parts volume expanded flue-cured tobacco having a nicotine content of about 4 percent. The volume expanded cut filler mixture is added to each lot using a mixture drum in order to provide a well mixed blend having a moisture content of between about 12 percent and about 13 percent.

The resulting blend provided from the first lot of filler material has about 1 percent of the levulinic acid applied thereto (based on the filler dry weight) and is designated as Sample No. 11. The resulting blend provided from the second lot of filler material has about 3 percent of the levulinic acid applied thereto (based on the filler dry weight) and is designated as Sample No. 12. The resulting blend provided from the third lot of filler material has about 5 percent of the levulinic acid applied thereto (based on the filler dry weight) and is designated as Sample No. 13. The resulting blend provided from the fourth lot of filler material is not treated with the levulinic acid additive, is employed for comparison purposes, and is designated as Sample No. C-5.

The various cigarettes are smoked under FTC conditions. Data concerning (i) the nicotine content of each blend, (ii) FTC "tar," FTC nicotine and FTC carbon monoxide, (iii) the "tar"/nicotine ratio, (iv) puff count, and (v) pH of the mainstream aerosol for each sample, are presented in Table IV.

TABLE IV

| Sample | FTC "Tar"[1] (mg/cigarette) | FTC Nicotine[1] (mg/cigarette) | FTC CO[1] (mg/cigarette) | "Tar"/[2] Nicotine | Total[3] Nicotine (%) | Puff[4] Count | Smoke pH[5] minimum | Smoke pH[5] maximum | Average[6] Smoke pH |
|---|---|---|---|---|---|---|---|---|---|
| 11 | 5.2 | 0.54 | 6.95 | 9.63 | 2.55 | 6.0 | 6.25 | 6.57 | 6.43 |
| 12 | 4.9 | 0.56 | 6.53 | 8.75 | 2.64 | 5.9 | 6.35 | 6.75 | 6.28 |
| 13 | 5.1 | 0.60 | 6.53 | 8.50 | 2.58 | 6.0 | 5.69 | 5.97 | 5.56 |
| C-5* | 5.0 | 0.58 | 6.87 | 8.62 | 2.44 | 6.0 | 6.47 | 6.80 | 6.61 |

*Not an example of the invention.
[1-4]See Table I, footnotes 1-4, respectively.
[5]Smoke pH is determined using the techniques described in the Sensabaugh et al reference, supra. The presented minimum and maximum pH value for each cigarette are the calculated average of per-puff minimum and maximum values obtained for 7 puffs per cigarette.
[6]Average smoke pH is the "twenty port" smoke pH for the mainstream smoke of 20 cigarettes as determined using techniques described by Harris et at, supra.

The data in Table IV indicate that the various cigarettes of this inention having high nicotine content cut filler (i.e., more than 2.5 percent total blend nicotine) exhibit FTC "tar," nicotine and carbon monoxide deliveries comparable to the control cigarette. The various cigarettes also exhibit comparable FTC "tar" to nicotine ratios and puff counts. However, cigarettes of the invention (i.e., Sample Nos. 11–13 which contain levulinic cid additive) exhibit reduced mainstream by puff and average smoke pH when compared to a control (i.e., Sample No. C-5 which does not have the levulinic acid additive).

Organolepic evaluation of the samples indicates that the cigarettes of the invention are smooth smoking while the control sample is very harsh. The mildness of Sample Nos. 12 and 13 is considered comparable. The cigarettes of the invention yield good tobacco taste, strength and smoking satisfaction. The control sample is very strong, and the overpowering sensation provided thereby is not satisfying.

EXAMPLE 5

Cigarettes incorporating varying amounts of the levulinic acid are provided using the following procedure.

Cigarettes having lengths of about 84 mm and circumferences of about 24.85 mm have tobacco rod lengths of 57 mm and filter element lengths of 27 mm. The tobacco rod includes a charge of tobacco cut filler weighing about 0.82 g contained in a circumscribing cigarette paper wrap which is sold commercially as 856 Cigarette Paper by Ecusta Corp. The filter element is manufactured using conventional cigarette filter making technology from cellulose acetate tow (2.7 denier per filament, 48,000 total denier) and circumscribing air permeable paper plug wrap having a CORESTA porosity of about 26,000 cm/min. The tobacco rod and filter element are aligned in an abutting, end-to-end relatioship and secured together using essentially air impermeable tipping paper. The tipping paper is adhesively secured to the filter element and the adjacent portion of the tobacco rod. The tipping material circumscribes the length of the filter element and about 4 mm of the length of the tobacco rod. Cigarettes so described are manufactured using a Pilot Cigarette Maker from Hauni-Werke Korber & Co. KG. The cigarettes so manufactured are designated Sample Nos. 14, 15, 16 and C-6, corresponding to the sample of filler material from which each cigarette is manufactured.

The filler materials employed in providing the tobacco rods for Sample Nos. 14, 15, 16 and C-6 are the filler materials described for Sample Nos. 11, 12, 13 and C-5, respectively.

The various cigarettes are smoked under FTC conditions. Data concerning (i) the nicotine content of each blend, (ii) FTC "tar" and FTC nicotine, (iii) the "tar"-/nicotine ratio, (iv) puff count, and (v) pH of the mainstream aerosol for each sample, are presented in Table V.

TABLE V

| Sample | FTC "Tar"[1] (mg/cigarette) | FTC Nicotine[1] (mg/cigarette) | "Tar"/[2] Nicotine | Total[3] Nicotine (%) | Puff[4] Count | Average[5] Smoke pH |
|---|---|---|---|---|---|---|
| 14 | 9.3 | 0.87 | 10.7 | 2.55 | 7.1 | 6.36 |
| 15 | 9.4 | 0.91 | 10.3 | 2.64 | 7.0 | 5.56 |
| 16 | 11.0 | 1.06 | 10.4 | 2.58 | 7.0 | 5.56 |

TABLE V-continued

| Sample | FTC "Tar"[1] (mg/cigarette) | FTC Nicotine[1] (mg/cigarette) | "Tar"/[2] Nicotine | Total[3] Nicotine (%) | Puff[4] Count | Average[5] Smoke pH |
|---|---|---|---|---|---|---|
| C-6* | 9.6 | 0.86 | 11.2 | 2.44 | 7.1 | 6.54 |

*Not an example of the invention.
[1-4]See Table I, footnotes 1-4, respectively.
[5]Average smoke pH is the "twenty port" smoke pH for the mainstream smoke of 20 cigarettes as determined using techniques described by Harris et al, supra.

The data in Table V indicate that the various cigarettes of this invention having high nicotine content cut filler (i.e., more than 2.5 percent total blend nicotine) exhibit FTC "tar" and nicotine deliveries comparable to the control cigarette. The various cigarettes also exhibit comparable FTC "tar" to nicotine ratios and puff counts. However, cigarettes of the invention (i.e., Sample Nos. 14–16 which contain levulinic acid additive) exhibit reduced average smoke pH when compared to a control (i.e., Sample No. C-6 which does not have the levulinic acid additive).

Organolepic evaluation of the samples indicates that the cigarettes of the invention are smooth smoking while the control sample is very harsh. the mildness of Sample Nos. 15 and 16 is considered comparable. The cigarettes of the invention yield good tobacco taste, strength and smoking satisfaction. The control sample is very strong, and the overpowering sensation provided thereby is not satisfying.

What is claimed is:

1. A cigarette having smokable material contained in a circumscribing outer wrapping material, the cigarette having (i) a nicotine content greater than about 2 percent, based on the dry weight of the smokable material, and (ii) levulinic acid in dissociated and/or nondissociated form incorporated therein in an amount greater than about 1 percent, based on the dry weight of the smokable material.

2. The cigarette of claim 1 wherein the smokable material is smokable cut filler material.

3. The cigarette of claim 1 wherein essentially all of the levulinic acid is in nondissociated form.

4. The cigarette of claim 1 wherein at least a portion of the levulinic acid is provided to the cigarette in the form of nicotine levulinate.

5. The cigarette of claim 1, 2, 3 or 4 having a ratio of FTC "tar" to FTC nicotine of less than 7.

6. The cigarette of claim 1, 2, 3 or 4 having a ratio of FTC "tar" to FTC nicotine within the range of 3 to 6.

7. The cigarette of claim 1, 2, 3 or 4 wherein the levulinic acid additive is incorporated therein in an amount greater than about 2 percent, based on the dry weight of the smokable material.

8. The cigarette of claim 1, 2, 3 or 4 wherein the levulinic acid additive is incorporated therein in an amount greater than about 3 percent, based on the dry weight of the smokable material.

9. The cigarette of claim 1 or 3 including a filter element, at least a portion of the levulinic acid being present within the filter element.

10. A cigarette having smokable material contained in a circumscribing outer wrapping material, the cigarette having (i) a nicotine content greater than about 2.25 percent, based on the dry weight of the smokable material, and (ii) levulinic acid in dissociated and/or nondissociated form incorporated therein in an amount greater than about 1 percent, based on the dry weight of the smokable material.

11. The cigarette of claim 10 wherein the smokable material is smokable cut filler material.

12. The cigarette of claim 10 wherein essentially all of the levulinic acid is in nondissociated form.

13. The cigarette of claim 10 wherein at least a portion of the levulinic acid is provided to the cigarette in the form of nicotine levulinate.

14. The cigarette of claim 10, 11, 12, or 13 having a ratio of FTC "tar" to FTC nicotine of less than 7.

15. The cigarette of claim 10, 11, 12 or 13 having a ratio of FTC "tar" to FTC nicotine within the range of 3 to 6.

16. The cigarette of claim 10, 11, 12 or 13 wherein the organic acid additive is incorpoated therein in an amount greater than about 2 percent, based on the dry weight of the smokable material.

17. The cigarette of claim 10, 11, 12 or 13 wherein the organic acid additive is incorporated therein in an amount greater than about 3 percent, based on the dry weight of the smokable material.

18. A cigarette of claim 10 or 12 including a filter element, at least a portion of the levulinic acid being present within the filter element.

19. A cigarette having smokable material contained in a circumscribing outer wrapping material, the cigarette having (i) a nicotine content greater than about 2.5 percent, based on the dry weight of the smokable material, and (ii) levulinic acid in dissociated and/or nondissociated form incorporated therein in an amount greater than about 1 percent, based on the dry weight of the smokable material.

20. The cigarette of claim 19 wherein the smokable material is smokable cut filler material.

21. The cigarette of claim 19 wherein essentially all of the levulinic acid is in nondissociated form.

22. The cigarette of claim 19 wherein a portion of the levulinic acid is provided to the cigarette in the form of nicotine levulinate.

23. The cigarette of claim 19, 20, 21 or 22 having a ratio of FTC "tar" to FTC nicotine of less than 7.

24. The cigarette of claim 19, 20, 21 or 22 having a ratio of FTC "tar" to FTC nicotine within the range of 3 to 6.

25. The cigarette of claim 19, 20, 21 or 22 wherein the organic acid additive is incorporated therein in an amount greater than about 2 percent, based on the dry weight of the smokable material.

26. The cigarette of claim 19, 20, 21 or 22 wherein the organic acid additive is incorporated therein in an amount greater than about 3 percent, based on the dry weight of the smokable material.

27. The cigarette of claim 19 or 21 including a filter element, at least a portion of the levulinic acid being present within the filter element.

28. A cigarette having smokable material contained in a circumscribing outer wrapping material, the cigarette having (i) a nicotine content greater than about 3 percent, based on the dry weight of the smokable material, and (ii) levulinic acid in dissociated and/or nondissociated form incorporated therein in an amount greater than about 1 percent, based on the dry weight of the smokable material.

29. The cigarette of claim 28 wherein the smokable material is smokable cut filler material.

30. The cigarette of claim 28 wherein essentially all of the levulinic acid is in nondissociated form.

31. The cigarette of claim 28 wherein a portion of the levulinic acid is provided to the cigarette in the form of nicotine levulinate.

32. The cigarette of claim 28, 29, 30 or 31 having a ratio of FTC "tar" to FTC nicotine of less than 7.

33. The cigarette of claim 28, 29, 30 or 31 having a ratio of FTC "tar" to FTC nicotine within the range of 3 to 6.

34. The cigarette of claim 28, 29, 30 or 31 wherein the organic acid additive is incorporated therein in an amount greater than about 2 percent, based on the dry weight of the smokable material.

35. The cigarette of claim 28, 29, 30 or 31 wherein the organic acid additive is incorporated therein in an amount greater than about 3 percent, based on the dry weight of the smokable material.

36. The cigarette of claim 28 or 30 including a filter element, at least a portion of the levulinic acid being present within the filter element.

* * * * *